US006149147A

United States Patent [19]

Hur et al.

[11] Patent Number: 6,149,147

[45] Date of Patent: Nov. 21, 2000

[54] PAPER PICKUP DEVICE IN PAPER FEEDING CASSETTE

[75] Inventors: Kiel-Jae Hur; Seo-Won Park, both of Kyonggi-do; Se-Hyun Lyu, Inchonkwangyok-shi, all of Rep. of Korea

[73] Assignee: SamSung Electronics Co., Ltd., Suwon, Rep. of Korea

[21] Appl. No.: 09/208,023

[22] Filed: Dec. 9, 1998

Related U.S. Application Data

[63] Continuation-in-part of application No. 09/168,375, Oct. 8, 1998.

[30] Foreign Application Priority Data

| | | | |
|---|---|---|---|
| Oct. 8, 1997 | [KR] | Rep. of Korea | 97-27888 |
| Nov. 3, 1997 | [KR] | Rep. of Korea | 97-30916 |
| Dec. 9, 1997 | [KR] | Rep. of Korea | 97-36232 |

[51] Int. Cl.[7] ..... B65H 1/10; B65H 1/12

[52] U.S. Cl. ..... 271/160; 271/147

[58] Field of Search ..... 271/160, 147

[56] References Cited

U.S. PATENT DOCUMENTS

| | | | |
|---|---|---|---|
| 4,350,328 | 9/1982 | Katakura et al. | 271/22 |
| 4,793,606 | 12/1988 | Yasuoka et al. . | |
| 4,830,353 | 5/1989 | Hendriks et al. . | |
| 4,982,943 | 1/1991 | Weiss | 271/157 |
| 5,181,713 | 1/1993 | Neugebauer . | |
| 5,222,725 | 6/1993 | Kasahara et al. | 271/160 |
| 5,401,014 | 3/1995 | Okabe et al. | 271/255 |
| 5,443,252 | 8/1995 | Morinaga et al. . | |
| 5,823,525 | 10/1998 | Miki . | |

FOREIGN PATENT DOCUMENTS

| | | | |
|---|---|---|---|
| 56-113631 | 9/1981 | Japan | 271/160 |
| 2-188319 | 7/1990 | Japan | 271/160 |

OTHER PUBLICATIONS

Patent Abstracts of Japan, vol. 095, No. 011, Dec. 25, 1995 & JP 07 206180A (Canon Inc.), Aug. 8, 1995.

*Primary Examiner*—Donald P. Walsh
*Assistant Examiner*—David A Jones
*Attorney, Agent, or Firm*—Robert E. Bushnell, Esq.

[57] ABSTRACT

There is provided a paper pickup device in a paper feeding cassette having a knock-up plate. In the paper pickup device, a first curved slot is formed on a frontal portion of each sidewall of the paper feeding cassette, a second curved slot is formed above the first slot on one sidewall of the paper feeding cassette, a shaft is protrusively inserted into the first slots from the inside of the paper feeding cassette, a connecting member is rotatably connected to the sidewalls of the paper feeding cassette by hinges, and has a first engaging portion extended upward from a body thereof and a second engaging portion horizontally spaced from the first engaging portion by a predetermined distance and a sub-plate is extended from the connecting member under the knock-up plate, for pressing upward the knock-up plate. A link lever has a spring fixing portion extended downward and a rib extended downward from an end of the link lever, the rib being inserted into the second slot from the sidewall of the paper feeding cassette. A first tension coil spring has one end connected to the first engaging portion and the other end connected to the shaft, for causing the subplate to press upward the knock-up plate, and a second tension coil spring has one end connected to the second engaging portion and the other end connected to the spring fixing portion of the link lever, for adding to the tensile force of the first tension coil spring.

7 Claims, 6 Drawing Sheets

PAPER PICKUP DEVICE IN PAPER FEEDING CASSETTE

CROSS REFERENCES TO THE RELATED APPLICATIONS AND CLAIM OF PRIORITY

This application is a continuation-in-part application to a co-pending U.S. patent application Ser. No. 09/168,375 entitled PAPER PICKUP DEVICE IN PAPER FEEDING CASSETTE earlier filed on Oct. 8, 1998 and makes reference to, incorporates the same herein, and claims all benefits accruing under 35 U.S.C. §§ 119 and 120. This application makes reference to, incorporates the same herein, and claims all benefits accruing under 35 U.S.C. § 119 from an application for PAPER PICKUP DEVICE IN PAPER FEEDING CASSETTE earlier filed in the Korean Industrial Property Office on Oct. 8, 1997 and there duly assigned Ser. No. 27888/1997, from an application for PAPER PICKUP DEVICE IN PAPER FEEDING CASSETTE earlier filed in the Korean Industrial Property Office on Nov. 3, 1997 and there duly assigned Ser. No. 30916/1997, and from an application for PAPER PICKUP DEVICE IN PAPER FEEDING CASSETTE earlier filed in the Korean Industrial Property Office on Dec. 9, 1997 and there duly assigned Ser. No. 36232/1997.

BACKGROUND OF THE INVENTION

1. Field of the Invention

The present invention relates to a paper feeding cassette in a laser beam printer (LBP) using an electrophotographic developing method, and in particular, to a paper pickup device installed to keep plural sheets of paper in a pickup position.

2. Description of the Related Art

Electrophotographic development is used in printers, copiers, LBPs, facsimile machines and related devices. Such a device is equipped with a paper feeding cassette to accommodate plural sheets of paper, and the paper feeding cassette has a paper pickup device for keeping the paper pile in a pickup position.

Some examples of paper pickup devices of the conventional art are seen, for example, in the following U.S. patents. U.S. Pat. No. 4,793,606, to Yasuoka et al., entitled Paper Feeding Device for A Printer, discloses a paper feeding device for a printer which includes a paper feeding tray and a tray receiver. U.S. Pat. No. 4,830,353, to Hendricks et al., entitled Device For Holding a Stack of Sheets And Discharging Them From The Top Thereof, discloses a device for discharging sheets having a holder for a stack of sheets such that the stack is pressed against a conveyor roller disposed at a fixed location above the holder. U.S. Pat. No. 5,181,713, to Neugebauer, entitled Paper Tray For A Copying Machine, discloses a paper tray arrangement for receiving a stack of paper and which is insertable into a receiving device of a copying machine.

A paper pickup device is disclosed in a co-pending U.S. patent application Ser. No. 09/168,375 and a description of its structure is incorporated herein. In the mechanism of this device, with a subplate placed even, a first tension coil spring is strained between a first engaging portion of a connecting member and a shaft. The strained first tension coil spring applies a force to move a knock-up plate to a pickup position. The uppermost paper sheet of a paper pile on the knock-up plate is transferred by rotation of a pickup roller in close contact with the pickup roller.

Meanwhile, a second tension coil spring is kept stationary, that is, it is not strained. No tensile force is applied to the second tension coil spring because a slot is curved and the distance between a second engaging portion of the connecting member and an end of a lever is not changed by rotation of the connecting member around a hinge shaft. As a result, when the lever end is positioned in a portion of the slot, only the first tension coil spring is strained with pickup force, that is, the second tension coil spring is not strained.

When a paper pile is placed with a maximum load on a paper feeding cassette, user manipulation to rotate a locker around a hinge and position the lever end in the other portion of the slot increases the distance between the second engaging portion and the lever end Thus, the second tension coil spring is strained with a tensile force. That is, the user can freely strain the second tension coil spring by displacing the lever along the curved slot.

Here, the locker is fixedly positioned by a stopper and the force of the lever and the second tension coil spring In this state, the second tension coil spring is strained between the lever and the second engaging portion. It can be concluded that the user can strain the second tension coil spring by displacing the lever end along the slot and thus changing the distance between the second engaging portion and the lever. In addition, the shaft can be selectively positioned in two portions of a slot, which allows the user to freely adjust application of a paper pickup force along with the movement of the shaft.

However, the above paper pickup device suffers from the disadvantages that assembly is difficult and reliability of parts is decreased due to a large part tolerance involved in designing caused by requirement for many parts.

SUMMARY OF THE INVENTION

It is therefore an object of the present invention to provide an improved paper pickup device for a laser beam printer.

It is also an object of the present invention to provide a paper pickup device which enables papers of different sizes and weights to be reliably picked up.

It is another object of the invention to provide a paper pickup device which requires fewer parts than existing paper pickup devices.

It is still another object of the present invention to provide a paper pickup device which has a reduced part tolerance.

It is yet another object of the present invention to provide a paper pickup device which has improved reliability.

It is a further object of the present invention to provide a paper pickup device which is easier to assemble.

It is a still further object of the present invention to provide a paper pickup device which is less expensive.

To achieve these and other objects, there is provided a paper pickup device in a paper feeding cassette having a knock-up plate. In the paper pickup device, a first curved slot is formed on a frontal portion of each sidewall of the paper feeding cassette, a second curved slot is formed above the first slot on one sidewall of the paper feeding cassette, a shaft is protrusively inserted into the first slots from the inside of the paper feeding cassette, a connecting member is rotatably connected to the sidewalls of the paper feeding cassette by hinges, and has a first engaging portion extended upward from a body thereof and a second engaging portion horizontally spaced from the first engaging portion by a predetermined distance, and a sub-plate is extended from the connecting member under the knock-up plate, for pressing the knock-up plate upward. A link lever has a spring fixing portion extended downward and a rib extended downward from an end of the link lever, the rib being inserted into the second slot from the sidewall of the paper feeding cassette. A first tension coil spring has one end connected to the first engaging portion and the other end connected to the shaft, for causing the subplate to press upward the knock-up plate, and a second tension coil spring has one end connected to the second engaging portion and the other end connected to the spring fixing portion of the link lever, for adding to the tensile force of the first tension coil spring.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE DRAWINGS

Figure 1:
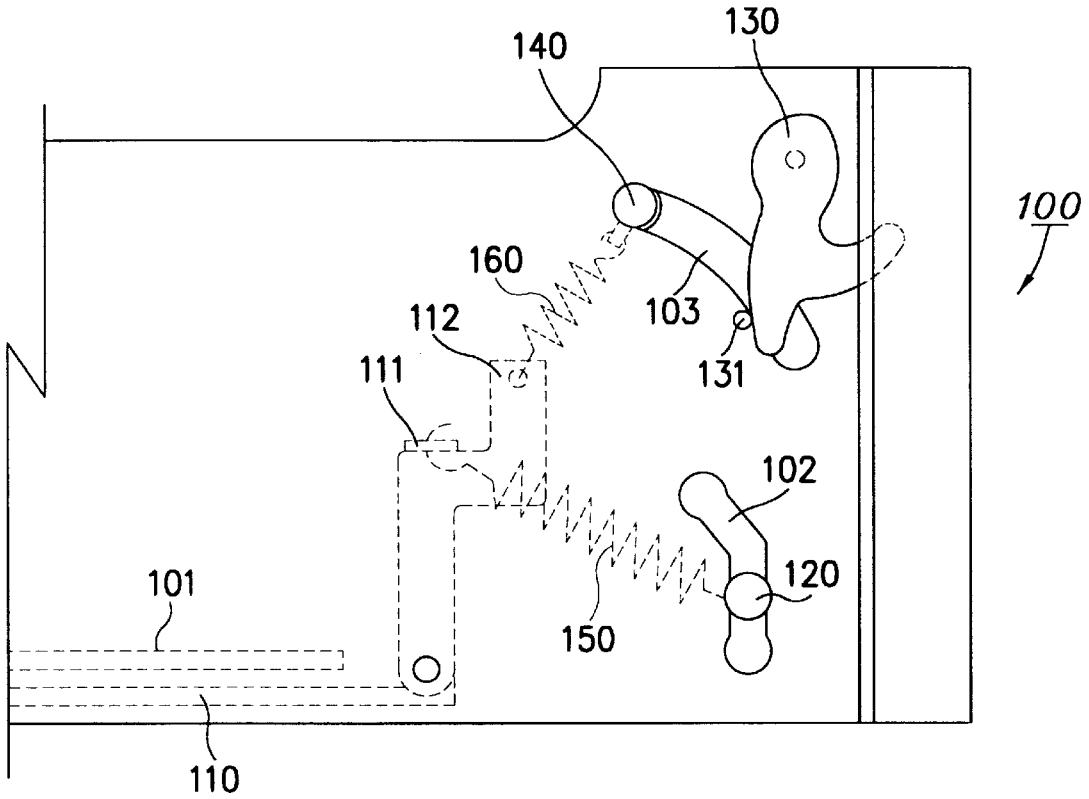
FIG. 1 is a schematic view of a paper pickup device with a tensile force applied to a first tension coil spring.
Figure 2:
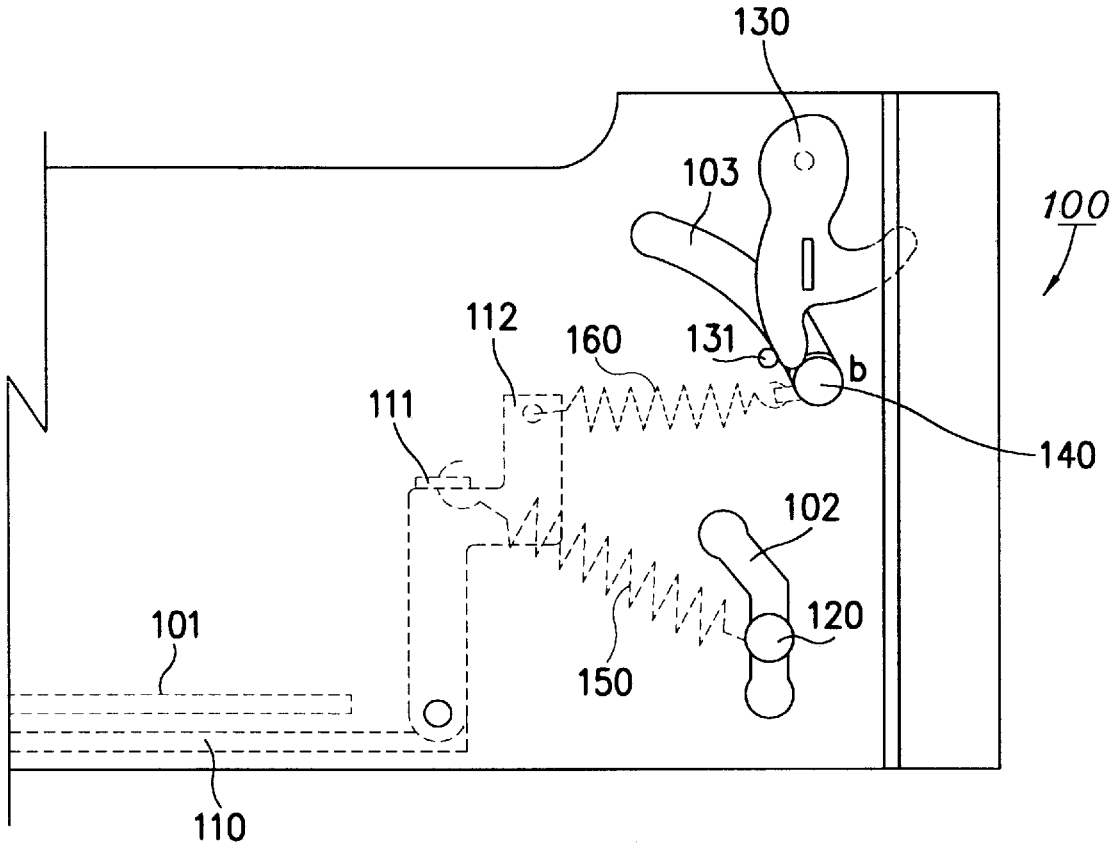
FIG. 2 is a schematic view of the paper pickup device of FIG. 1, with tensile force applied to both the first and second tension coil springs.

A paper pickup device is disclosed in a co-pending U.S. patent application Ser. No. 09/168,375 and a description of its structure is incorporated herein. In the mechanism of the above device, with subplate 110 placed even, first tension coil spring 150 is strained between first engaging portion 111 of a connecting member and shaft 120, as shown in FIGS. 1 and 2. The strained first tension coil spring 150 applies a force to move knock-up plate 101 to a pickup position. The uppermost paper sheet of a paper pile on knock-up plate 101 is transferred by rotation of a pickup roller (not shown) in close contact with the pickup roller.

Meanwhile, second tension coil spring 160 is kept stationary, that is, not strained. No tensile force is applied to second tension coil spring 160 because slot 103 is curved and the distance between second engaging portion 112 of the connecting member and end 140 of a lever is not changed in spite of rotation of the connecting member around a hinge shaft. As a result, when lever end 140 is positioned in a portion of slot 103, only first tension coil spring 150 is strained with pickup force, that is, second tension coil spring 160 is not strained.

As shown in FIG. 2, when a paper pile is placed with a maximum load on paper feeding cassette 100, user manipulation to rotate locker 130 around a hinge and position lever end 140 in the other portion of slot 103 increases the distance between second engaging portion 112 and lever end 140. Thus, second tension coil spring 160 is strained with a tensile force. That is, the user can freely strain second tension coil spring 160 by displacing the lever along curved slot 103.

Here, locker 130 is fixedly positioned by stopper 131 and the force of the lever and second tension coil spring 160. In this state, second tension coil spring 160 is strained between the lever and second engaging portion 112. It can be concluded that the user can strain second tension coil spring 160 by displacing lever end 140 along slot 103, thus changing the distance between second engaging portion 112 and the lever. In addition, shaft 120 is selectively positioned in two portions of slot 102, which allows the user to freely adjust application of a paper pickup force along with the movement of shaft 120.

A detailed description of a preferred embodiment of the present invention will hereinbelow be given with reference to the attached drawings. It is to be noted that like reference numerals denote the same components in the drawings and a detailed description of a known related function or structure of the present invention is omitted if it is deemed to obscure the subject matter of the present invention.

Figure 3:
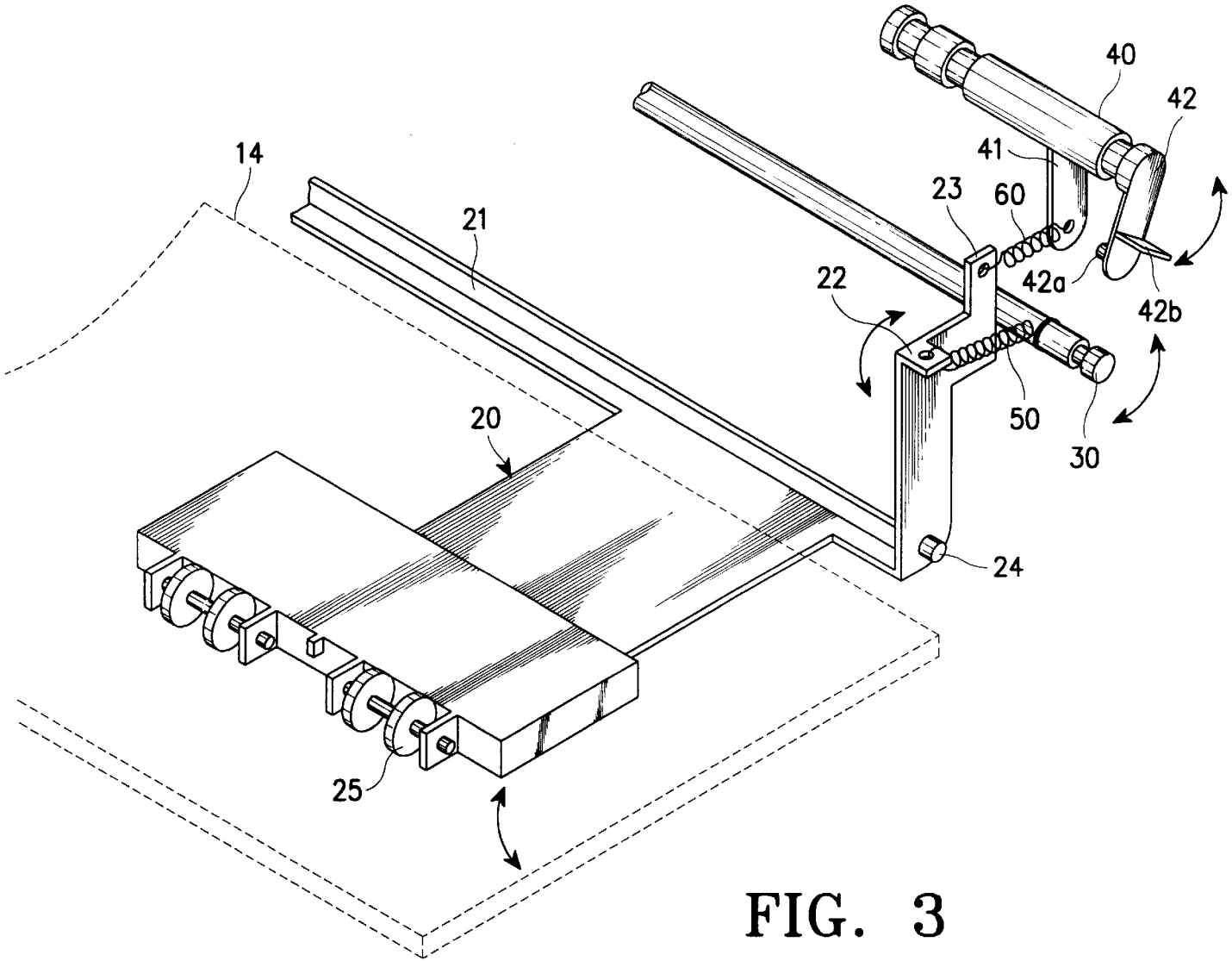
FIG. 3 is a schematic perspective view of a paper pickup device according to a preferred embodiment of the present invention.
Figure 4:
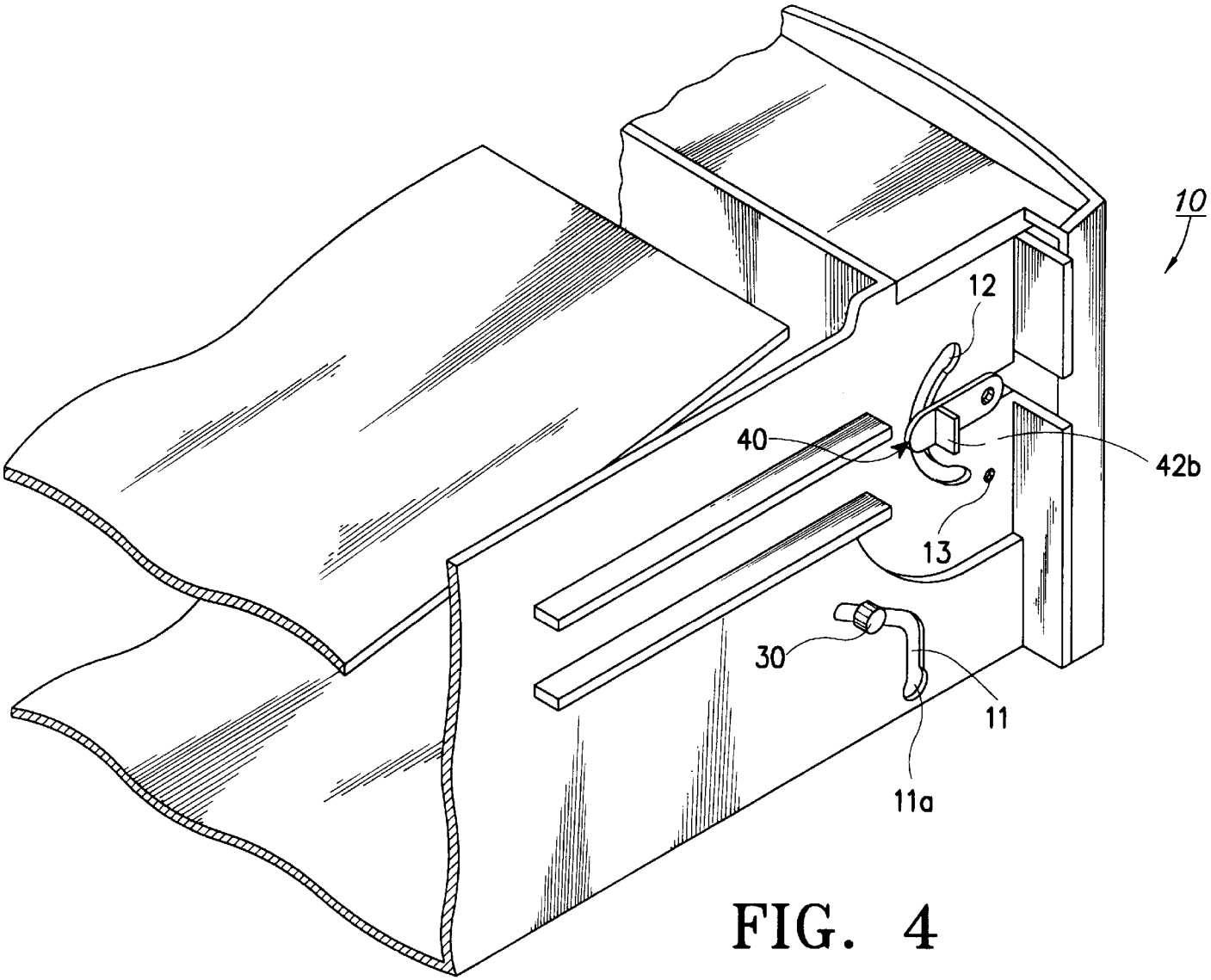
FIG. 4 is a partial perspective view showing the exterior of a paper feeding cassette having the paper pickup device according to the embodiment of the present invention.

FIG. 3 is a schematic perspective view of a paper pickup device according to a preferred embodiment of the present invention, and FIG. 4 is a partial perspective view showing the exterior of a paper feeding cassette having the paper pickup device. Referring to FIGS. 3 and 4, first curved slot 11 is formed on a frontal portion of each side wall of paper feeding cassette 10 to protrusively insert shaft 30 thereinto. Second curved slot 12 is formed just above first slot 11 on one sidewall of paper feeding cassette 10. Iinsertion hole 13 is formed at one side of second slot 12. First slot 11 gets wider in a lower portion thereof so as to keep shaft 30 in position.

Under knock-up plate 14 of paper feeding cassette 10 is placed subplate 20 for pressing upward knock-up plate 10. Subplate 20 is rotatably connected to the sidewalls of paper feeding cassette 10 by hinges 24 through connecting member 21. Connecting member 21 has first engaging portion 22 extended upward from the body thereof and second engaging portion 23 horizontally spaced from first engaging portion 22 by a predetermined distance.

Shaft-shaped link lever 40 is prepared to be inserted into second slot 12. Spring fixing portion 41 is extended downward from link lever 40, and rib 42 is extended downward from an end of link lever 40 to be inserted into second slot 12 from the sidewall of paper feeding cassette 10. Rib 42 has protrusion 42*a* on the inner surface to be inserted into insertion hole 13, for keeping link lever 40 in position. Knob 42*b* is formed on the outer surface of rib 42 perpendicularly to the outer surface, for facilitating user manipulation of link lever 40.

Then, first tension coil spring 50 connects first engaging portion 22 to shaft 30, for causing subplate 20 to press up knock-up plate 14. Second tension coil spring 60 connects second engaging portion 23 to spring fixing portion 41 of link lever 40, for adding to the tensile force of first tension coil spring 50. A plurality of rollers 25 are provided in an area where subplate 20 contacts knock-up plate 14 to make contact with the lower surface of knock-up plate 14.

Figure 5:
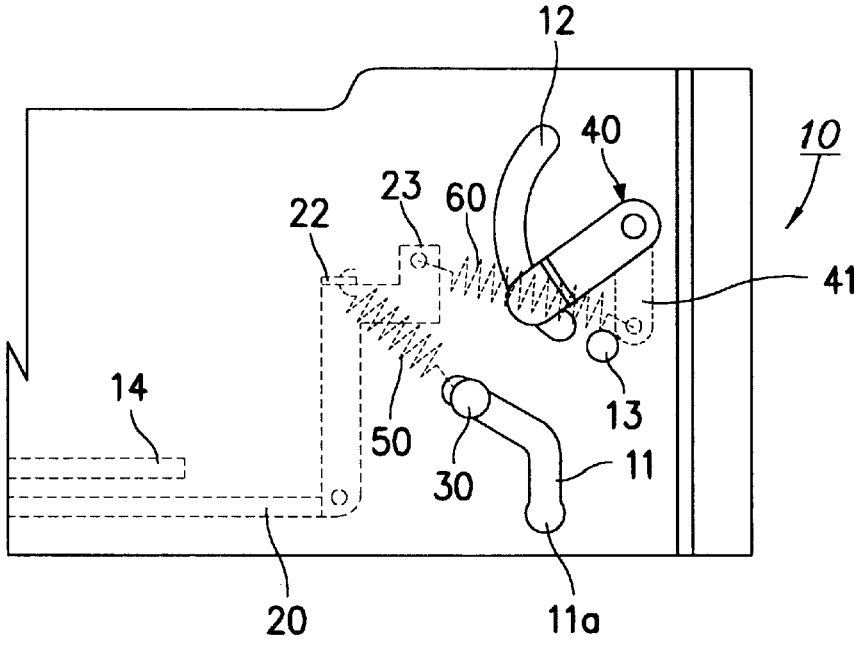
FIG. 5 is a side view of the paper pickup device according to the embodiment of the present invention.
Figure 6:
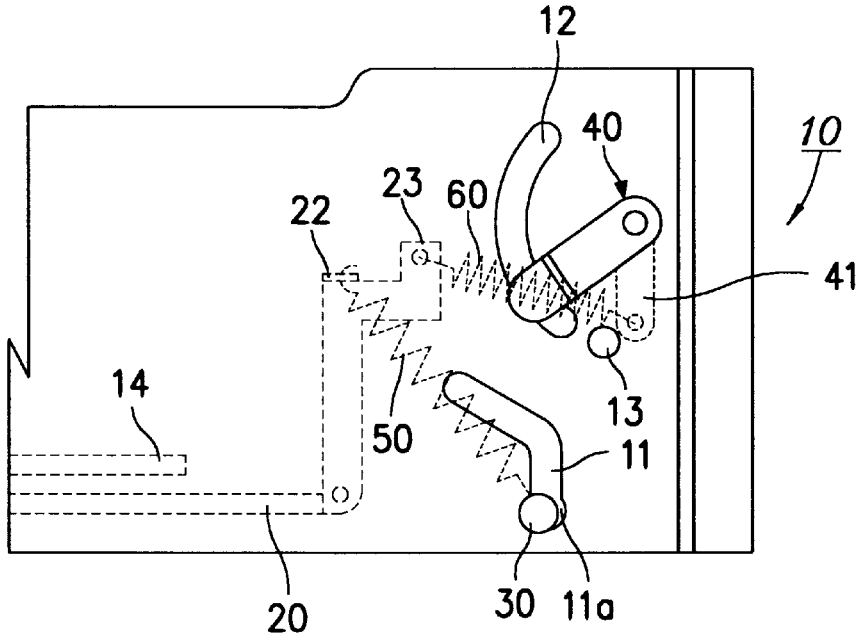
FIG. 6 is a side view of the paper pickup device with tensile force applied to a first tension coil spring.
Figure 7:
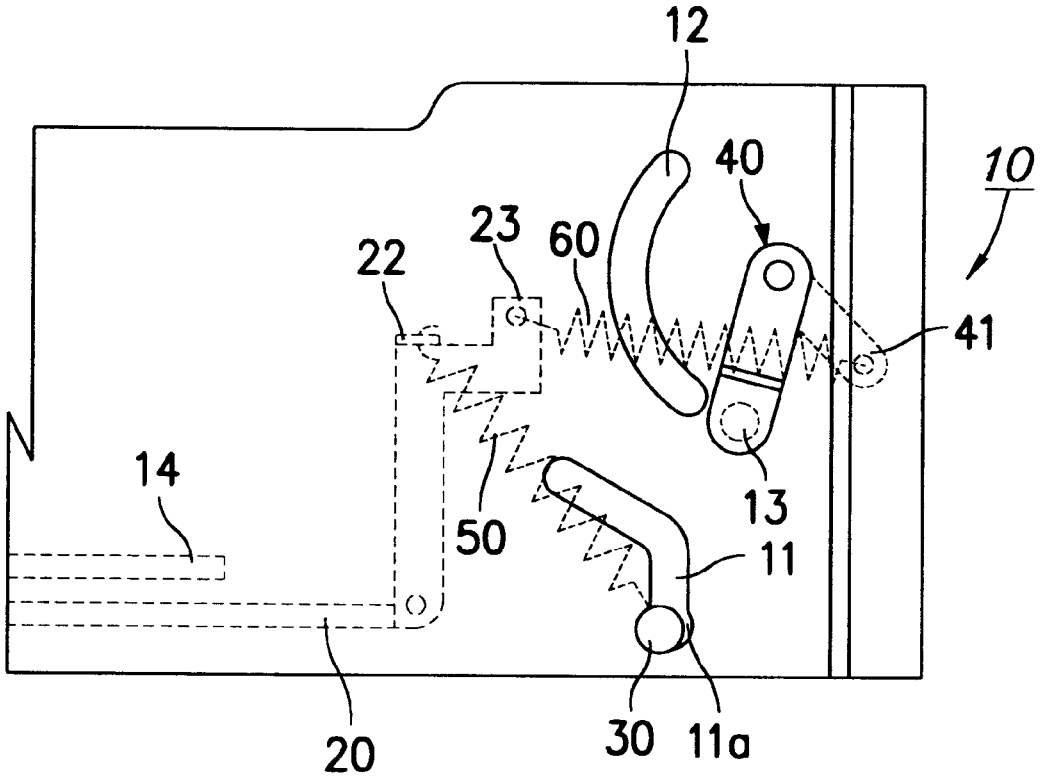
FIG. 7 is a side view of the paper pickup device with tensile force applied to both the first and second tension coil springs.

FIG. 5 is a side view of the paper pickup device according to the embodiment of the present invention, FIG. 6 is a side view of the paper pickup device with tensile force applied to the first tension coil spring, and FIG. 7 is a side view of the paper pickup device with tensile force applied to both the first and second tension coil springs. Referring to FIG. 5, shaft 30 is positioned in an upper portion of first slot 11 and link lever 40 can make a free movement along second slot 12. In this state, subplate 20 applies a minimum upward pressure to knock-up plate 14.

Referring to FIG. 6, with user displacement of shaft 30 to lower portion 11*a* of first slot 11, a predetermined tensile force is applied to first tension coil spring 50 and link lever 40 can move freely along second slot 12. In this state, since first tension coil spring 50 applies the tensile force to subplate 20, subplate 20 presses upward the knock-up plate 14 with a stronger force than in FIG. 5.

Referring to FIG. 7, with shaft 30 positioned in lower portion 11*a* of first slot 11 and protrusion 42*a* of link lever 40 inserted into insertion hole 13 by user manipulation, both first and second tension coil springs 50 and 60 are concurrently strained. Since the tensile force of first and second tension coil springs 50 and 60 is simultaneously applied to subplate 20, subplate 20 presses upward knock-up plate 14 with a maximum force.

As described above, the present invention is advantageous in that application of tensile force to the subplate can be simply controlled in stages with use of just two parts.

While the present invention has been described in detail with reference to the specific embodiment, it is a mere exemplary application. Thus, it is to be clearly understood that many variations can be made by anyone skilled in the art within the scope and spirit of the present invention.

What is claimed is:

1. A paper pickup device for a laser beam printer, comprising:

a paper feeding cassette having two sidewalls, each sidewall having a first curved slot in a frontal portion of said sidewall and each sidewall having a second curved slot formed above said first curved slot;

a knock-up plate in the paper feeding cassette;

a shaft installed between said sidewalls of said paper feeding cassette so as to protrude from said first curved slots;

a connecting member rotatably connected to said sidewalls of said paper feeding cassette;

a first engaging portion extending upward from said connecting member;

a second engaging portion connected to and horizontally spaced from said first engaging portion;

a subplate extending from said connecting member, said subplate being under said knock-up plate;

a link lever which is shaft-shaped, disposed between said sidewalls;

a spring-fixing portion extending downward from said link lever;

a rib extending downward from an end of said link lever, said rib being inserted into said second slot;

a first tension coil spring having one end connected to said first engaging portion and a second end connected to said shaft so as to press said subplate upward against said knockup plate; and a second tension coil spring having one end connected to said second engaging portion and the other end connected to said spring-fixing portion of said link lever so as to additionally press said subplate upward against said knock-up plate.

2. The paper pickup device of claim 1, further comprised of said first curved slot having a first terminal end separated by a length of said first curved slot from a second terminal end with said second terminal end exhibiting a width that is shaped wider than a width exhibited by said first curved slot along said length.

3. The paper pickup device of claim 1, further comprising:

a sidewall of said paper feeding cassette having an insertion hole on one side of said second curved slot;

a protrusion on the inner surface of said rib, said protrusion being insertable into said insertion hole.

4. The paper pickup device of claim 1, further comprising:

a knob formed on the outer surface of said rib for manipulation of said link lever by a user.

5. The paper pickup device of claim 4, further comprising:

said knob extending perpendicular to said outer surface of said rib.

6. The paper pickup device of claim 1, further comprising:

a roller mounted on said subplate and contacting a lower surface of said knock-up plate.

7. The paper pickup device of claim 6, further comprising:

a plurality of rollers mounted on said subplate and contacting a lower surface of said knock-up plate.

* * * * *